US006773320B2

(12) United States Patent
Uchikawa et al.

(10) Patent No.: US 6,773,320 B2
(45) Date of Patent: Aug. 10, 2004

(54) HIGH PRESSURE DISCHARGE LAMP AND METHOD FOR SEALING A BULB THEREOF

(75) Inventors: Tatsuya Uchikawa, Tokyo (JP); Kazuhisa Nishida, Tokyo (JP)

(73) Assignee: NEC Microwave Tube, Ltd., Sagamihara (JP)

( * ) Notice: Subject to any disclaimer, the term of this patent is extended or adjusted under 35 U.S.C. 154(b) by 0 days.

(21) Appl. No.: 10/294,662

(22) Filed: Nov. 15, 2002

(65) Prior Publication Data

US 2003/0067270 A1 Apr. 10, 2003

Related U.S. Application Data

(62) Division of application No. 09/803,655, filed on Mar. 12, 2001.

(30) Foreign Application Priority Data

Mar. 13, 2000 (JP) ..... 2000-069172
Aug. 10, 2000 (JP) ..... 2000-242998

(51) Int. Cl.[7] ..... H01J 9/00
(52) U.S. Cl. ..... 445/26
(58) Field of Search ..... 313/634, 623, 313/624, 625, 633, 631, 637, 638, 639, 640, 641, 642, 574; 445/26, 27, 22, 29, 32, 33, 38

(56) References Cited

U.S. PATENT DOCUMENTS 3,685,880 A * 8/1972 Sobieski ..... 445/26
4,633,136 A 12/1986 Fromm et al.
5,001,395 A 3/1991 Barthelmes et al.
5,404,077 A * 4/1995 Eichelbronner et al. .... 313/623
5,635,796 A * 6/1997 Genz ..... 313/641
6,086,441 A 7/2000 Akiguchi et al.
6,211,616 B1 * 4/2001 Takeuti et al. ..... 313/637
6,232,719 B1 * 5/2001 Kaneko et al. ..... 313/625
6,249,086 B1 * 6/2001 Honda et al. ..... 313/631
6,271,628 B1 * 8/2001 Sugitani et al. ..... 313/637

FOREIGN PATENT DOCUMENTS

| | | |
|---|---|---|
| DE | 10030808 A1 | 1/2001 |
| JP | 60-165400 | 8/1985 |
| JP | 63-195947 | 8/1988 |
| JP | 02-148561 | 6/1990 |
| JP | 07-226185 | 8/1995 |
| JP | 10-106492 | 4/1998 |
| JP | 11-016502 | 1/1999 |
| JP | 11-14899 | 6/1999 |
| JP | 2000-100377 | 4/2000 |

OTHER PUBLICATIONS

Japanese Office Action dated Jan. 7, 2003 with a partial English translation.

* cited by examiner

*Primary Examiner*—Vip Patel
*Assistant Examiner*—Sharlene Leurig
(74) *Attorney, Agent, or Firm*—McGinn & Gibb, PLLC

(57) ABSTRACT

A high pressure discharge lamp includes a quartz glass bulb, a conductive element which is sealed at a sealing portion of the bulb, and a pair of electrodes. Each electrode is disposed in the quartz glass bulb so as to be opposite the other and connected to the conductive element. A part of each electrode is sealed with the quartz glass bulb at the sealing portion so as to generate a contacting portion formed by the part of each electrode and the bulb. The maximum length, $L_{max}$, of the contacting portion is defined as: $L_{max}((mm)) \leqq /200/(P \times D)$; and the minimum length, $L_{min}$, of the contacting portion is defined as: $L_{min}((mm)) \geqq 0.8/(D^2 \times \pi)$ or $L_{min}((mm)) \geqq 0.7$ whichever is longer, where D is the diameter ((mm)) of the electrode and P is the power (W) supplied to the electrode.

11 Claims, 8 Drawing Sheets

HIGH PRESSURE DISCHARGE LAMP AND METHOD FOR SEALING A BULB THEREOF

The present Application is a Divisional Application of U.S. patent application No. 09/803,655, filed on Mar. 12, 2001.

BACKGROUND OF THE INVENTION

1. Field of the Invention

The present invention relates to a high pressure discharge lamp and a method for sealing a bulb of the high pressure discharge lamp. More specifically, the present invention relates to a high pressure discharge lamp which may be used as a light source for such devices as a copier or a projector and which, even after being lit for a considerably long time, does not have problems such as a blowout of the bulb made of quartz glass or the blackening of the quartz glass bulb, and a method for sealing a bulb used in such a high pressure discharge lamp.

2. Description of the Related Art

In general, high pressure discharge bulbs have a structure in which each electrode of a pair of electrodes (i.e., an anode and a cathode) is disposed so as to be opposite the other in a quartz glass bulb, which includes an expanded portion for luminescence and a sealing portion, and the anode and the cathode are joined by, for instance, welding with molybdenum foil. Also, the sealing portion of the quartz glass bulb is airtightly sealed by, for example, welding with molybdenum foil. A gas for assisting an electric discharge, such as mercury vapor, is contained in the expanded portion for luminescence of the quartz glass bulb which has been airtightly sealed.

In general, high pressure discharge lamps which may be represented by a xenon lamp, a high pressure mercury lamp, and a metal halide lamp, have high brightness and excellent color rendering properties, and are used as light sources for such devices as a copier or a projector.

FIG. 8 is a diagram showing a configuration of a conventional high pressure discharge lamp. The high pressure discharge lamp includes a pair of electrodes 2*a* and 2*b*, which are disposed so as to be opposite each other, and a material which is capable of maintaining a light discharge of the lamp is contained in a tubular quartz glass bulb 1. The electrodes 2*a* and 2*b* are connected to molybdenum (Mo) foils 3*a* and 3*b*, respectively, and both ends of the quartz glass bulb 1 are sealed with a part of the electrodes 2*a* and 2*b* and the Mo foils 3*a* and 3*b*. The electrode 2*a* and the Mo foil 3*a*, and the electrode 2*b* and the Mo foil 3*b*, respectively, may be connected by using a welding method. Also, mercury vapor and an inert gas, for instance, are used as the materials capable of maintaining a light discharge and are contained in the quartz glass bulb 1.

In the above-mentioned high pressure discharge lamp, an external lead wire (not shown in the figure) is connected to the Mo foils 3*a* and 3*b*, which are sealed at their respective ends of the quartz glass bulb 1, and a predetermined trigger voltage is applied to the external lead wires. When the trigger voltage is applied, a glow discharge is induced between the electrodes 2*a* and 2*b* in the inert gas atmosphere thereby vaporizing mercury contained in the quartz glass bulb 1, and this causes a plasma discharge in the high pressure mercury vapor. The light emitted by the plasma discharge has high brightness and excellent color rendering properties.

As mentioned above, in the high pressure discharge lamp, an inert gas is contained and sealed in the quartz glass bulb

1 as a starting gas for the glow discharge, and the charged pressure thereof is between 6 kPa and 60 kPa (preferably between 20 kPa and 50 kPa). For this reason, the difference in pressure between the inside and outside of the quartz glass bulb 1, i.e., the difference between the atmospheric pressure and the charged pressure, is in the range between 41 kPa and 95 kPa. As a method for carrying out airtight-sealing of the quartz glass bulb 1, a pinch sealing method and a shrink sealing method are known.

The pinch sealing method is a method in which an outer periphery portion of a quartz glass bulb is collapsed and sealed by pressure applied using a force piston provided with a metallic mold. This method is mainly used for a sealing process in which the internal pressure of an object is about 4–5 MPa. If the pinch sealing method is employed, however, residual distortion tends to be generated after applying pressure. Also, stress concentrations tend to be caused since the shape of the quartz glass bulb and that of a sealing metal at the contacting portion thereof are significantly different. Accordingly, if the pinch sealing method is applied to the above-mentioned high pressure discharge lamp, there is a danger that the quartz glass bulb 1 may blow out.

The shrink sealing method, on the other hand, is a method in which an outer periphery of both ends of a quartz glass bulb is heated while the pressure difference between the inside and outside of the quartz glass is maintained, and, thereafter, the quartz glass bulb is naturally shrunk in order to airtightly seal the bulb. The shrink sealing method is applicable to a sealing process in which the internal pressure of a quartz glass bulb is 20 MPa or greater. According to this method, contrary to the pinch sealing method, a forced pressure is not applied to the bulb and residual distortion does not tend to be generated since the quartz glass bulb is subjected to natural shrinkage. Also, since the shape of the quartz glass bulb and that of a sealing metal foil are substantially the same, stress concentration tends not to be caused. For this reason, the shrink sealing method is often used as the sealing process for the above-mentioned high pressure discharge lamp.

However, in the conventional shrink sealing method, the difference between the thermal expansion coefficient of the quartz glass bulb and that of the electrodes is not considered at all when carrying out the sealing process of the bulb of a high pressure discharge lamp. Also, a heating step for the quartz glass bulb during the sealing process is conventionally carried out manually and it was difficult to obtain an accurate target length of a contacting portion which is formed by contacting an electrode with the quartz glass bulb at the sealing portion. For the case where the length of the contacting portion formed by the electrode and the quartz glass bulb at the contacting portion is relatively long, cracks may be generated at the sealing portions, as shown in FIG. 9, due to the difference between the thermal expansion coefficient of the electrode and the quartz glass bulb. When the internal pressure of the quartz glass bulb 1 is increased upon lighting the high pressure discharge lamp, the cracks may develop into a large cleft and become the cause of a bulb blowout. Moreover, although it is possible to suppress the generation of cracks by decreasing the length of the contacting portion formed by the electrode and the quartz glass bulb at the sealing portions, there is a danger that problems such as the falling of an electrode may be caused by decreasing the length of the contacting portion.

On the other hand, when a conventional high pressure discharge lamp is used, sputtering is vigorously caused and this causes blackening of the quartz glass bulb in a relatively short amount of time. Also, if the amount of halogen gas contained in the high pressure discharge lamp is increased to enhance the halogen cycle efficiency in order to prevent the blackening caused by the electrode sputtering, the sealing portion of the electrode tends to be eroded by the halogen gas and this eventually causes a blowout of the quartz glass bulb.

Accordingly, an object of the present invention is to solve the above-mentioned problems and provide a high pressure discharge lamp and a method for sealing a bulb thereof by which the generation of cracks during the sealing process may be suppressed and problems such as the falling of an electrode are not caused.

Another object of the present invention is to provide a high pressure discharge lamp by which a blowout of the quartz glass bulb or the blackening of the quartz glass bulb may be prevented even after being lit for a considerably long time.

The inventors of the present invention, after pursuing diligent studies to achieve the above-mentioned objectives, have noticed the importance of the length L of the contacting portion which is formed by contacting the electrode and the quartz glass bulb at the sealing portion be in the range between $L_{max}((mm)) \leqq 200/(P \times D)$ (the maximum length) and $L_{min}((mm)) \geqq 0.8/(D^2 \times \pi)$ or $L_{min}((mm)) \geqq 0.7$ whichever is longer (the minimum length), where D is the diameter ((mm)) of the electrode and P is the power (W) supplied to the high pressure discharge lamp.

Also, the inventors of the present invention have noticed the importance in the roughness of the surface of an end portion of the electrode and discovered that if the maximum value (hereinafter referred to as "$R_{max}$") of the surface roughness (hereinafter referred to as "R") of the end portion of the electrode is less than a certain value, it becomes possible to significantly decrease the sputtering of the electrode and, hence, prevent the blackening of the quartz glass bulb. The inventors of the present invention have also discovered that if the $R_{max}$ value of portions of the electrode other than the end portion is within in a certain range, it becomes possible to prevent a blowout of the quartz glass bulb.

SUMMARY OF THE INVENTION

The present invention provides a high pressure discharge lamp including: a quartz glass bulb; a conductive element which is airtightly sealed at a sealing portion of the quartz glass bulb; and a pair of electrodes, each electrode of the pair of electrodes being disposed in the quartz glass bulb so as to be opposite the other and each electrode of the pair of electrodes being connected to the conductive element, wherein a part of each electrode of the pair of electrodes is sealed with the quartz glass bulb at the sealing portion so as to generate a contacting portion formed by the part of each electrode of the pair of electrodes and the quartz glass bulb, and the maximum length, $L_{max}$, of the contacting portion is defined as:

$L_{max}((mm)) \leqq 200/(P \times D)$; and the minimum length, $L_{min}$, of the contacting portion is defined as:

$L_{min}((mm)) \geqq 0.8/(D^2 \times \pi)$ or $L_{min}((mm)) \geqq 0.7$ whichever is longer, where D is the diameter ((mm)) of the corresponding one of the pair of electrodes, and P is the power (W) supplied to the corresponding electrode of the pair of electrodes.

In accordance with one aspect of the invention, the conductive element is molybdenum.

In accordance with another aspect of the invention, the maximum value, $R_{max}$, of the surface roughness of the pair of electrodes at the contacting portion is about 5 $\mu$m or less, where $R_{max}$ is the maximum of the absolute value of the difference between the distance from the axial center of each of the electrodes to a particular point on the surface of each of the electrodes and the mean value of the distance.

In yet another aspect of the invention, the maximum value, $R_{max}$, of the surface roughness of the pair of electrodes at the contacting portion is in the range between about 2 $\mu$m and 3 $\mu$m.

The present invention also provides a method for sealing a bulb of a high pressure discharge lamp including a first electrode and a second electrode, the first and second electrodes being disposed in the bulb having a first insertion opening and a second insertion opening so as to be opposite the other, comprising the steps of: disposing the first electrode at the first insertion opening so that the first electrode is placed at a predetermined position in the axial direction of the electrode; heating a predetermined portion of the first insertion opening while maintaining a pressure difference between the inside and outside of the bulb; shrinking the predetermined portion of the first insertion opening in a natural state so that a part of the first electrode is sealed with the predetermined portion; disposing the second electrode at the second insertion opening so that the second electrode is placed at a predetermined position in the axial direction of the electrode; heating a predetermined portion of the second insertion opening while maintaining a pressure difference between the inside and outside of the bulb; and shrinking the predetermined portion of the second insertion opening in a natural state so that a part of the second electrode is sealed with the predetermined portion, wherein the length of a contacting portion formed by sealing the part of the first electrode with the bulb, and by the part of the second electrode with the bulb, is in the range between:

a maximum length, $L_{max}$, defined as:

$L_{max}((mm)) \leqq 200/(P \times D)$; and a minimum length, $L_{min}$, defined as:

$L_{min}((mm)) \geqq 0.8/(D^2 \times \pi)$ or $L_{min}((mm)) \geqq 0.7$ whichever is longer, where D is the diameter ((mm)) of the first electrode (or the second electrode) and P is the power (W) supplied to the first electrode (or the second electrode).

The present invention also provides a high pressure discharge lamp including: a quartz glass bulb; conductive elements, the conductive elements being airtightly sealed at sealing portions of the quartz glass bulb; and a pair of electrodes, each electrode of the pair of electrodes being disposed so as to be opposite the other and each electrode being connected to one of the conductive elements, wherein $R_{max}$ of an end portion of each of the electrodes is about 5 $\mu$m or less. Note that in this specification, the term "$R_{max}$" means the maximum of the absolute value of the difference between the distance from the axial center of an electrode to a particular point on the surface of the electrode and the mean value of the distance.

In accordance with one aspect of the invention, the conductive element is molybdenum.

In accordance with another aspect of the invention, the length of the end portion of each electrode is in the range between about P/150 and P/100 (mm) from an end of each electrode along the length of each electrode, where P is a supplied power to the high pressure discharge lamp in watts.

In yet another aspect of the invention, the maximum value of the surface roughness of the end portion of each of the electrodes is about 3 $\mu$m or less.

In yet another aspect of the invention, the maximum value of the surface roughness of the end portion of each of the electrodes is about 1 $\mu$m or less.

In yet another aspect of the invention, the maximum value of the surface roughness of the end portion of each of the electrodes is about 0.5 $\mu$m or less.

In yet another aspect of the invention, the maximum value of the surface roughness of a portion other than the end portion of each of the electrodes is in the range between about 5 $\mu$m and 12 $\mu$m.

In yet another aspect of the invention, the maximum value of the surface roughness of a portion other than the end portion of each of the electrodes is in the range between about 7 $\mu$m and 9 $\mu$m.

In yet another aspect of the invention, mercury vapor is contained in the high pressure discharge lamp in an amount between about 0.12 and 0.3 mg/(mm)$^3$.

In yet another aspect of the invention, a halogen gas is contained in the high pressure discharge lamp in an amount between about $10^{-8}$ and $10^{-2}$ $\mu$mol/(mm)$^3$.

In yet another aspect of the invention, an inert gas is contained in the high pressure discharge lamp with a pressure of about 6 kPa or more.

In yet another aspect of the invention, the pair of electrodes uses tungsten containing potassium oxide.

In yet another aspect of the invention, the bulb wall loading in the high pressure discharge lamp is about 0.8 W/(mm)$^2$ or more.

In yet another aspect of the invention, the end portion of each of the electrodes has a surface which is polished by a composite electrolytic polishing method.

BRIEF DESCRIPTION OF THE DRAWINGS

Some of the features and advantages of the invention have been described, and others will become apparent from the detailed description which follows and from the accompanying drawings, in which.

DETAILED DESCRIPTION OF THE INVENTION

The invention summarized above and defined by the enumerated claims may be better understood by referring to the following detailed description, which should be read with reference to the accompanying drawings. This detailed description of a particular preferred embodiment, set out below to enable one to build and use one particular implementation of the invention, is not intended to limit the enumerated claims, but to serve as a particular example thereof.

Figure 1:
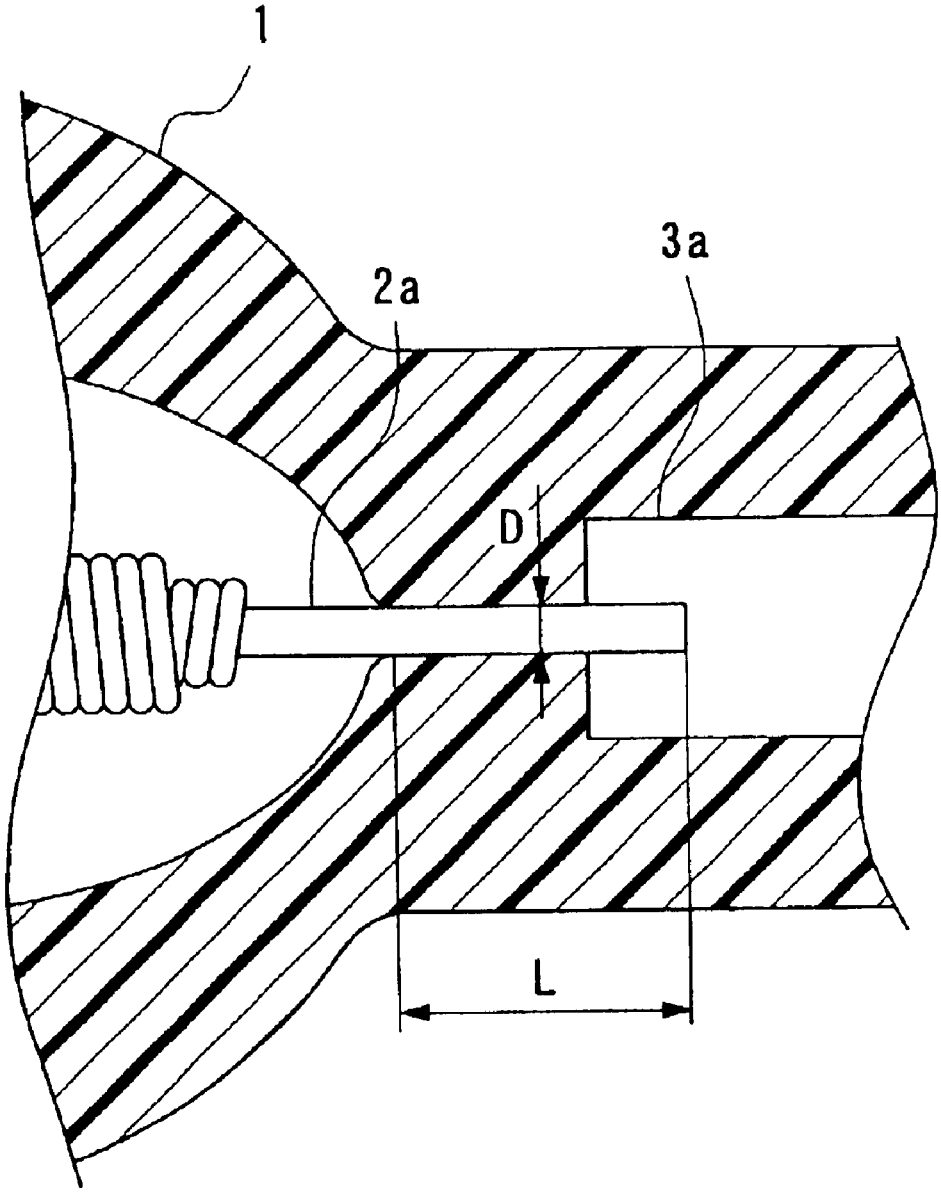
FIG. 1 is a diagram showing a schematic cross-sectional view of a high pressure discharge lamp according to an embodiment of the present invention.
Figure 8:
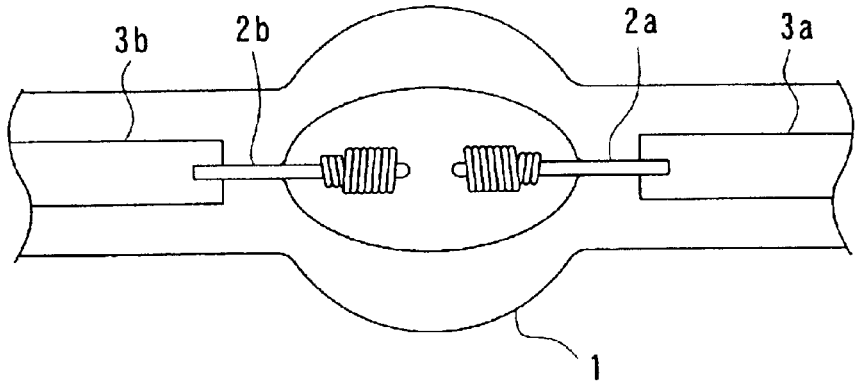
FIG. 8 is a diagram showing a configuration of a conventional high pressure discharge lamp.
Figure 9:
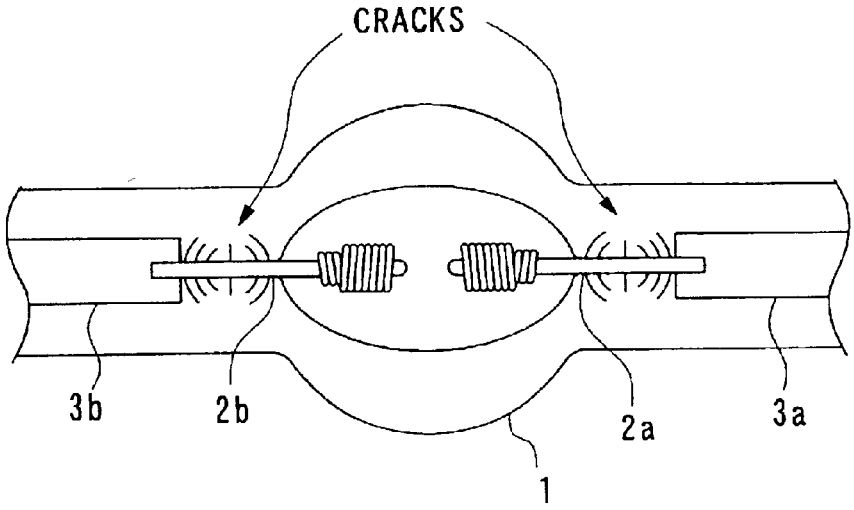
FIG. 9 is a diagram showing a configuration of a conventional high pressure discharge lamp in which cracks are generated at the sealing portions.

FIG. 1 is a structural diagram showing a partial cross-sectional view of a high pressure discharge lamp according to an embodiment of the present invention. The high pressure discharge lamp has the same structure as the one shown in FIG. 8 except that the length of the contacting portion formed by contacting the electrode and the quartz glass bulb is defined as the length for preventing the generation of cracks due to the difference in the thermal expansion coefficient between the quartz glass bulb and the electrode and for preventing the falling of the electrode. Note that in FIG. 1, the same numerals are used to indicate the same structural parts shown in FIG. 8.

In the high pressure discharge lamp according to this embodiment of the invention, as shown in FIG. 1, electrodes 2*a* and 2*b* are joined to Mo foils 3*a* and 3*b*, respectively, and a part of the electrodes 2*a* and 2*b* and the Mo foils 3*a* and 3*b* are sealed at their respective ends of a quartz glass bulb 1. The shrink sealing method is used for sealing the quartz glass bulb 1. That is, the sealing process is carried out by naturally shrinking the quartz glass bulb 1 after heating the quartz glass bulb 1 while maintaining a predetermined difference in pressure between the inside and outside of the quartz glass bulb 1.

The length L of the contacting portion which is formed by contacting the electrode 2*a* and the quartz glass bulb 1 at the sealing portion is defined as follows:

(the maximum length):

$L_{max}((mm)) \leqq 200/(P \times D)$; and (the minimum length):

$L_{min}((mm)) \geqq 0.8/(D^2\pi)$ or $L_{min}((mm)) \geqq 0.7$ whichever is longer, where D is the diameter ((mm)) of the electrode 2*a* and P is the power (W) supplied to the high pressure discharge lamp.

The same definition is also applied to the length of the contacting portion formed by contacting the electrode 2*b* and the quartz glass bulb 1.

In the high pressure discharge lamp having the length L of the contacting portion formed by the quartz glass bulb 1 and the electrodes 2*a* and 2*b*, respectively, since the strength of the contacting portions is not decreased and the generation of cracks at the contacting portions may also be suppressed, the quartz glass bulb 1 will not be blown out even if the lamp is operated with an internal pressure of about 8 MPa or greater.

Next, the basis for the derivation of the above-mentioned condition will be explained in more detail. In the following explanation, a quartz glass bulb 1 containing 0.12–0.30 mg/(mm)$^3$ of mercury and $10^{-8}$–$10^{-2}$ $\mu$mol/(mm)$^3$ of an inert gas is used as a sample to derive the condition.

Figure 2:
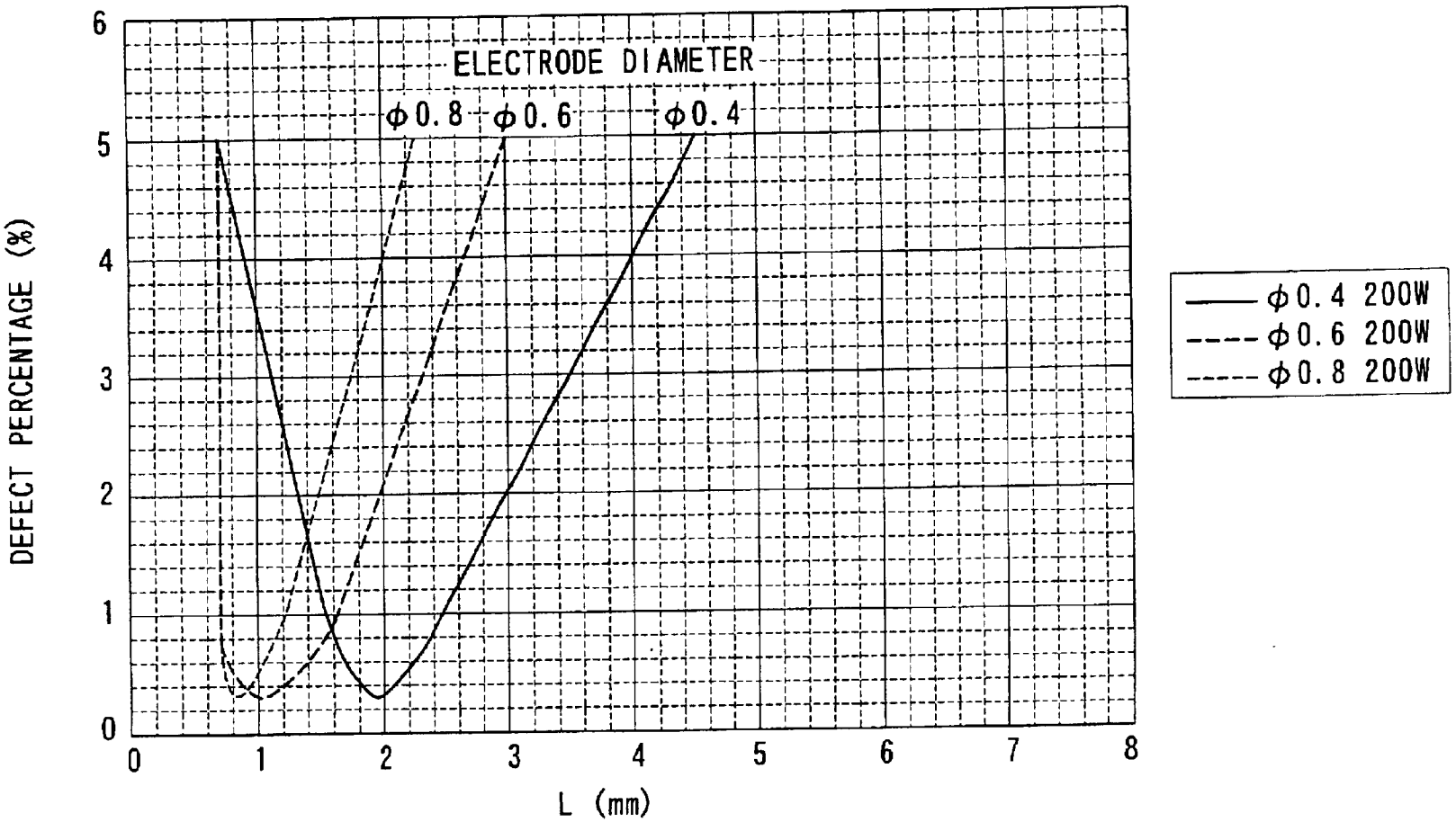
FIG. 2 is a graph showing the relationship between the length L of a contacting portion formed by sealing an electrode with a quartz glass bulb and the defect percentage where the power supplied to the high pressure discharge lamp is fixed at 200 (W) and the diameter $\phi$ of the electrode is varied among 0.4, 0.6, and 0.8 ((mm))
Figure 3:
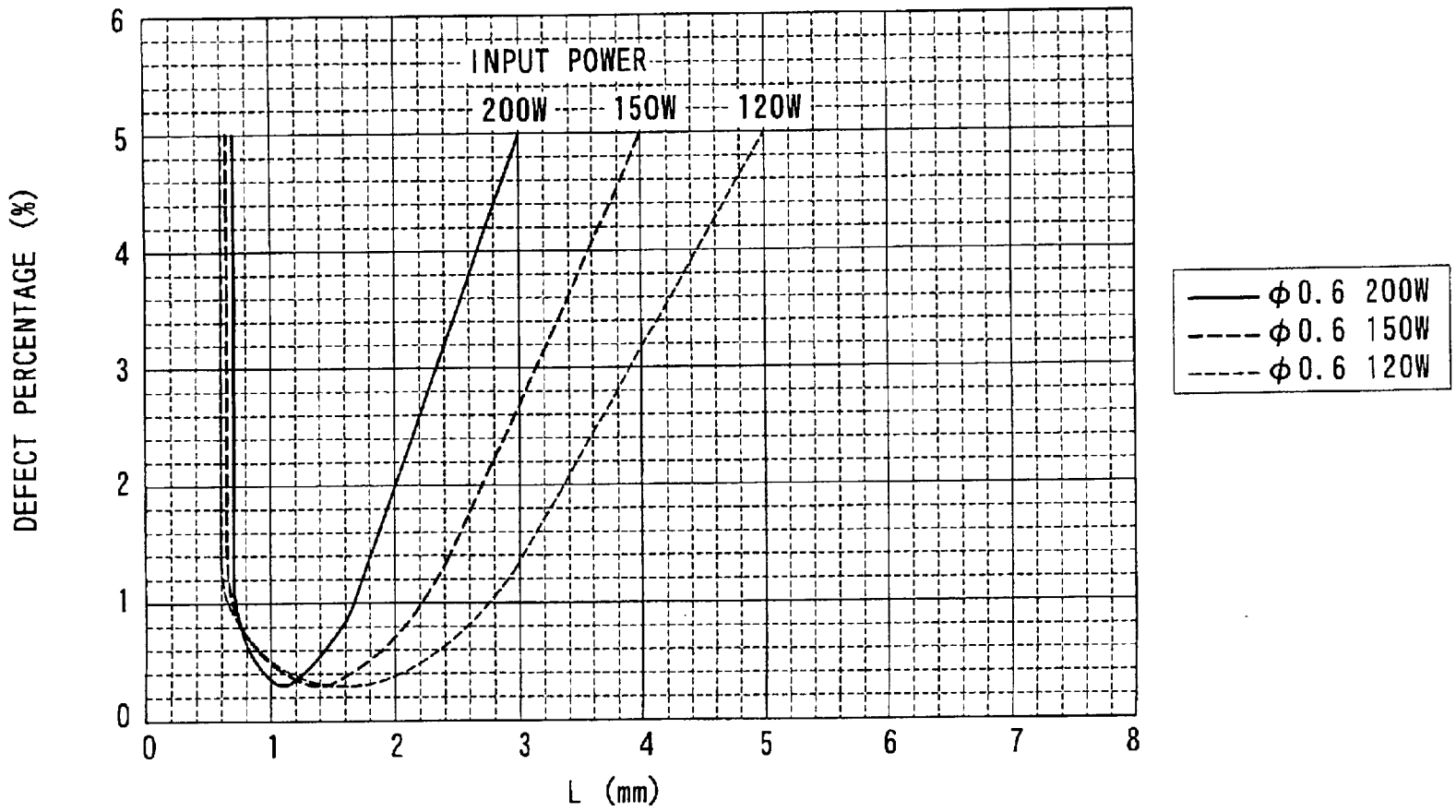
FIG. 3 is a graph showing the relationship between the length L of a contacting portion formed by sealing an electrode with a quartz glass bulb and the defect percentage where the diameter $\phi$ of the electrode is fixed at 0.6 ((mm)) and the power supplied to the high pressure discharge lamp is varied among 200, 150, and 120 (W)

FIG. 2 is a graph showing the relationship between the length L of a contacting portion formed by an electrode and a quartz glass bulb and the defect percentage when the power supplied to the high pressure discharge lamp is fixed at 200 (W) and the diameter ϕ of the electrode is varied among 0.4, 0.6, and 0.8 ((mm)). FIG. 3 is a graph showing the relationship between the length L of a contacting portion formed by an electrode and a quartz glass bulb and the defect percentage when the diameter ϕ of the electrode is fixed at 0.6 ((mm)) and the power supplied to the high pressure discharge lamp is varied among 200, 150, and 120 (W). The term "defect" in the "defect percentage" includes all kinds of defects, such as a blowout of the quartz glass bulb, falling of the electrode, or problems relating to manufacture, which are caused in the period between the initial operational stage and the end of the lifetime of the lamp (2000 hours in this embodiment).

Since a defect percentage of less than 1% at the termination of the lifetime of the high pressure discharge lamp is generally required, the maximum length $L_{max}$ and the minimum length $L_{min}$ of the length L of the contacting portion formed by the electrode and the quartz glass bulb were studied based on the data shown in FIGS. 2 and 3.

If the length L of the contacting portion formed by contacting the electrode and the quartz glass bulb is too long, cracks may be generated during the sealing process for the quartz glass bulb due to the difference between the thermal expansion coefficient of the electrode and the quartz glass bulb.

Accordingly, it is necessary to determine the maximum length of the length L of the contacting portion formed by the electrode and the quartz glass bulb in order to suppress the defect percentage due to the generation of cracks. Based on the data shown in FIGS. 2 and 3, the defect percentage increases in proportion to the increase in the diameter of the electrode and the power supplied to the high pressure discharge lamp and, hence, the length L of the contacting portion formed by the electrode and the quartz glass bulb may be increased as the diameter of the electrode and the power supplied to the high pressure discharge lamp are decreased. That is, the maximum length L of the contacting portion formed by the electrode and the quartz glass bulb is inversely proportional to the diameter of the electrode and the level of power supplied to the high pressure discharge lamp, and the coefficient for the relationship is calculated to be 200 based on the data shown in FIGS. 2 and 3. Accordingly, the maximum length L of the contacting portion formed by contacting the electrode and the quartz glass bulb may be defined as follows:

$$L_{max}((\text{mm}))\leqq 200/(P\times D)$$

where D is the diameter ((mm)) of the electrode and P is the power (W) supplied to the high pressure discharge lamp.

On the other hand, if the length L of the contacting portion formed by contacting the electrode and the quartz glass bulb is too short, the strength of the portion supporting the electrode is weakened and problems such as the falling of the electrode are caused. In order to prevent such problems, it is necessary to determine the minimum length of the length L of a contacting portion formed by the electrode and the quartz glass bulb. The minimum length of the length L of the contacting portion formed by the electrode and the quartz glass bulb depends on the diameter of the electrode and is inversely proportional to an increase in the cross-sectional area of the electrode. The coefficient for the relationship is calculated to be 0.8 based on the data shown in FIGS. 2 and 3. Accordingly, the minimum length of the length L of the contacting portion formed by contacting the electrode and the quartz glass bulb may be defined as follows:

$$L_{min}((\text{mm}))\geqq 0.8/(D^2\times\pi)$$

Note that at least 0.7 (mm) of contacting portion is known to be required for the construction of a quartz glass bulb and if the contacting portion has a length shorter than 0.7 (mm), the defect percentage is significantly increased. Accordingly, the minimum length of the length L of the contacting portion formed by the electrode and the quartz glass bulb needs to satisfy the following condition as well as the above-mentioned condition:

$$L_{min}((\text{mm}))\geqq 0.7$$

Figure 4:
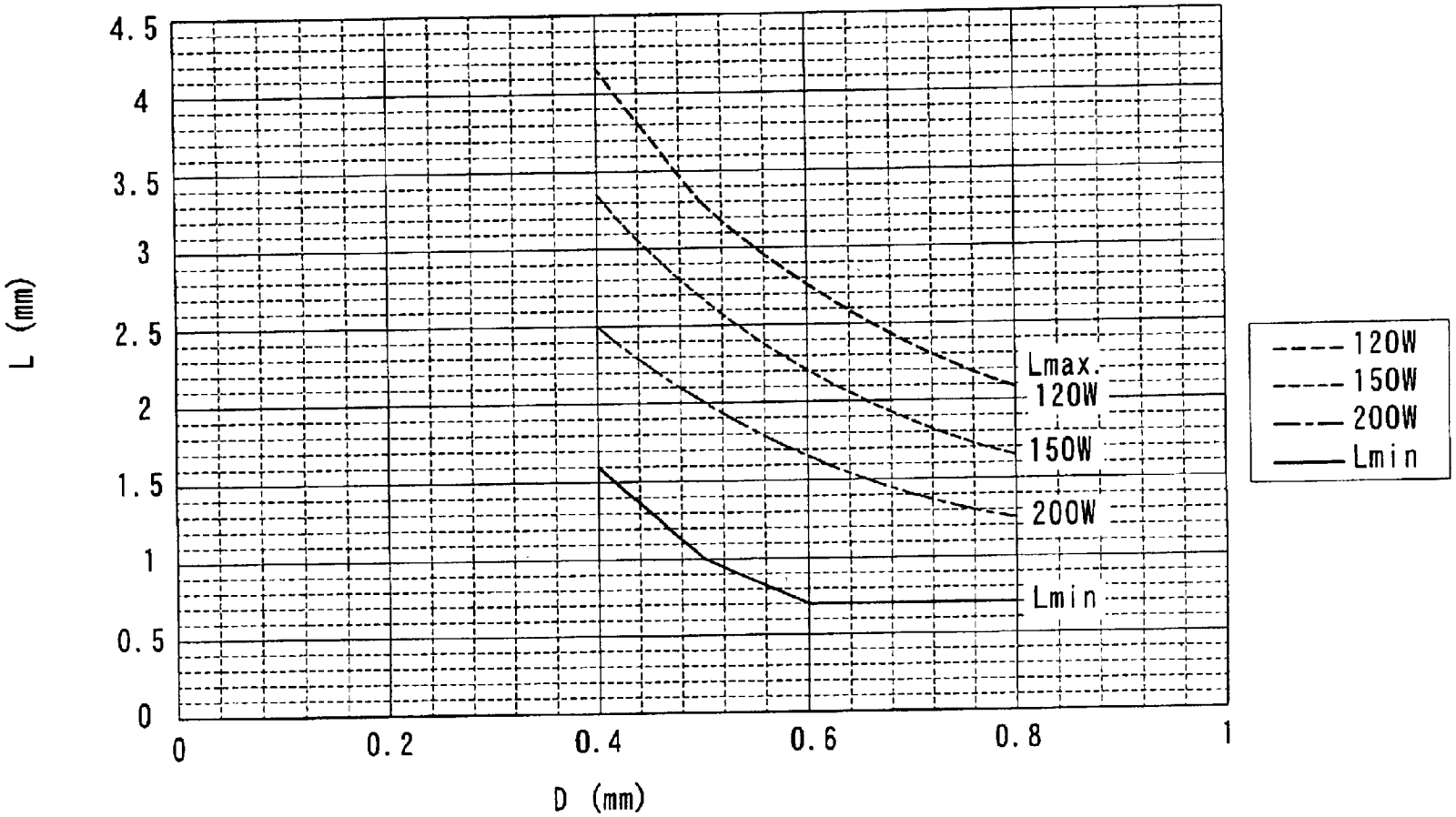
FIG. 4 is a graph showing the minimum length, $L_{min}$, where the diameter D of an electrode is in the range between 0.4 and 0.8 (mm), and the maximum length, $L_{max}$, where the power supplied to the high pressure discharge lamp is 200 W, 150 W, and 120 W, respectively.

FIG. 4 is a graph showing the minimum length $L_{min}$ when the diameter D of the electrode is in the range between 0.4 and 0.8 (mm), and the maximum lengths $L_{max}$ when the power supplied to the high pressure discharge lamp is 200 W, 150 W, and 120 W, respectively. It becomes possible to suppress the generation of cracks at the contacting portion without decreasing the strength thereof by defining the length L of the contacting portion formed by the electrode and the quartz glass bulb so as to fall in the range shown in FIG. 4. When experiments were conducted, no blowout of the quartz glass bulb was observed even when the lamps were operated with an internal pressure of the bulb of 8 MPa or greater.

Figure 5:
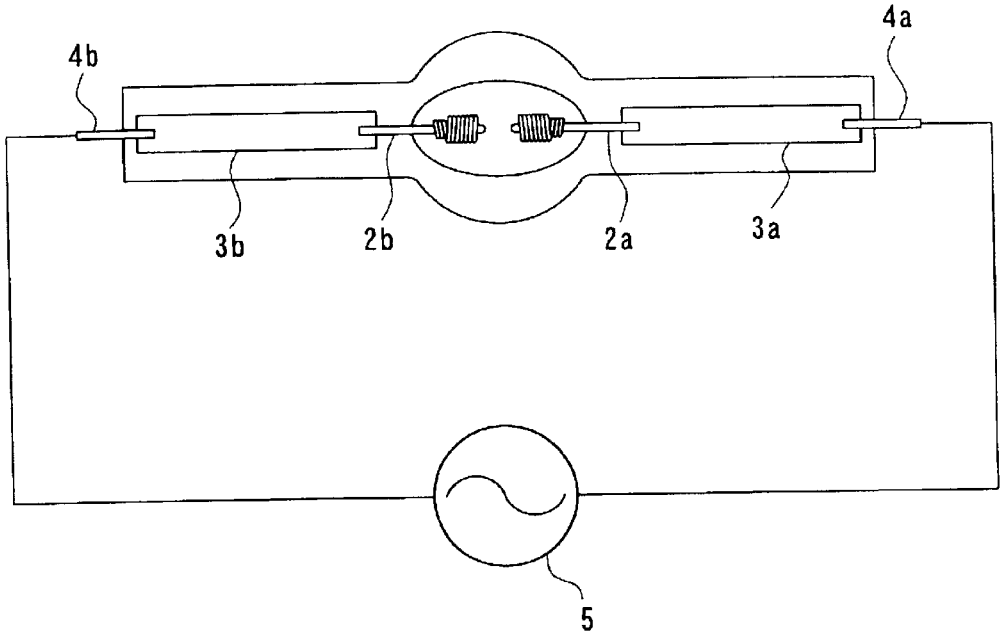
FIG. 5 is a diagram showing the schematic structure of a power supply system for a high pressure discharge lamp.

FIG. 5 is a diagram showing the schematic structure of a power supply system for a high pressure discharge lamp. External lead wires 4*a* and 4*b* are provided at the respective ends of the high pressure discharge lamp and are electrically connected to molybdenum foils 3*a* and 3*b*, respectively. A predetermined amount of electric power is supplied to the high pressure discharge lamp from a power supply 5 (AC power supply in this embodiment) via the external lead wires 4*a* and 4*b*.

Note that a DC power supply may be employed instead of the AC power supply. However, in such a case, the shape of the electrode tip will be different from the one shown in the figure. In general, the electrode for a DC power supply has a sharper tip and the diameter of the cathode is different from that of the anode.

When the high pressure discharge lamp is lighted, a trigger voltage is applied via the external lead wires 4*a* and 4*b* to induce a glow discharge between the electrodes 2*a* and 2*b*. In this manner, mercury contained in the quartz glass bulb 1 is vaporized and a plasma discharge may be generated in the high pressure mercury vapor so that light having high brightness and excellent color rendering properties may be emitted. When a stable state of the high pressure discharge lamp emitting light is obtained, a control unit (not shown in the figure) controls the electric power so that the power supplied to the high pressure discharge lamp becomes constant. In general, a voltage of about 50–100 V, by the DC or AC power supply, is applied to the external lead wires 4*a* and 4*b* in the stable state, and power of about 120–200 W is supplied to the high pressure discharge lamp.

Next, a method for sealing the bulb of a high pressure discharge lamp according to an embodiment of the present invention will be described in more detail.

The high pressure discharge lamp according to an embodiment of the present invention includes a quartz glass bulb having a pair of insertion openings (i.e., a first and a second insertion opening) used for inserting a respective electrode, each of which is disposed at an opposing position relative to the other. The method for sealing the bulb of a high pressure discharge lamp according to an embodiment of the present invention is a two-step method in which one of the pair of electrodes (or a first electrode) is sealed in the first step, and the other one of the pair of electrodes (or a second electrode) is sealed in the second step.

In the first step, the first electrode is disposed at the first insertion opening so that the first electrode is placed at a predetermined position in the axial direction, and the quartz glass bulb is evacuated until the partial pressure of oxygen (O) in the bulb is reduced to $2.5\times10^{-3}$ Pa or less. At that time, an inert gas may be introduced into the quartz glass bulb so that the pressure of the inert gas contained in the quartz glass bulb becomes about 6 kPa–60 kPa. After the evacuation, the quartz glass bulb is in a vacuum state in which the partial pressure of oxygen (O) in the bulb is $2.5\times10^{-3}$ Pa or less, or an inert gas with a sealing pressure of about 6 kPa–60 kPa is contained in the bulb. The difference in pressure between the inside and outside of the quartz glass bulb is 101 kPa in the vacuum state and 41 kPa–95 kPa for the case when the inert gas is introduced. While maintaining the pressure difference, an outer periphery of the quartz glass bulb, at which the Mo foil is inserted, is heated and then naturally shrunk so that the Mo foil and a part of the electrode is airtightly sealed with the quartz glass bulb.

In the second step, mercury is introduced into the quartz glass bulb through the second insertion opening, the second electrode is disposed at the second insertion opening so that the second electrode is placed at a predetermined position in the axial direction, and the quartz glass bulb is evacuated until the partial pressure of oxygen (O) in the bulb is reduced to $2.5\times10^{-3}$ Pa or less. After that, a halogen gas and optionally an inert gas are introduced into the quartz glass bulb. After evacuation, the pressure of the halogen gas and the inert gas contained in the quartz glass bulb is about 6 kPa–60 kPa, and the pressure difference between the inside and outside of the bulb, i.e., the difference between the atmospheric pressure and the charged pressure, is in the range between about 41 kPa and 95 kPa. While maintaining the pressure difference, an outer periphery of the quartz glass bulb, at which the Mo foil is inserted, is heated as in the first step and then the bulb is naturally shrunk so that the Mo foil and a part of the second electrode is airtightly sealed with the quartz glass bulb.

The contact of a quartz glass bulb with an electrode in the sealing process is a physical one, and the melted quartz glass bulb makes contact with the electrode so as to follow the convex-concave surface (rough surface) of the electrode during the sealing process. The quartz glass bulb is then solidified. After the sealing process, when the temperature of the contacting portion is cooled down to an ordinary temperature, the shape of the quartz glass bulb at the contacting portion is subtly different from the shape of the surface of the electrode due to the difference in the thermal expansion coefficient between the two. Accordingly, stress is generated at the sealing portion, and this is also one of the causes of cracks.

Figure 6:
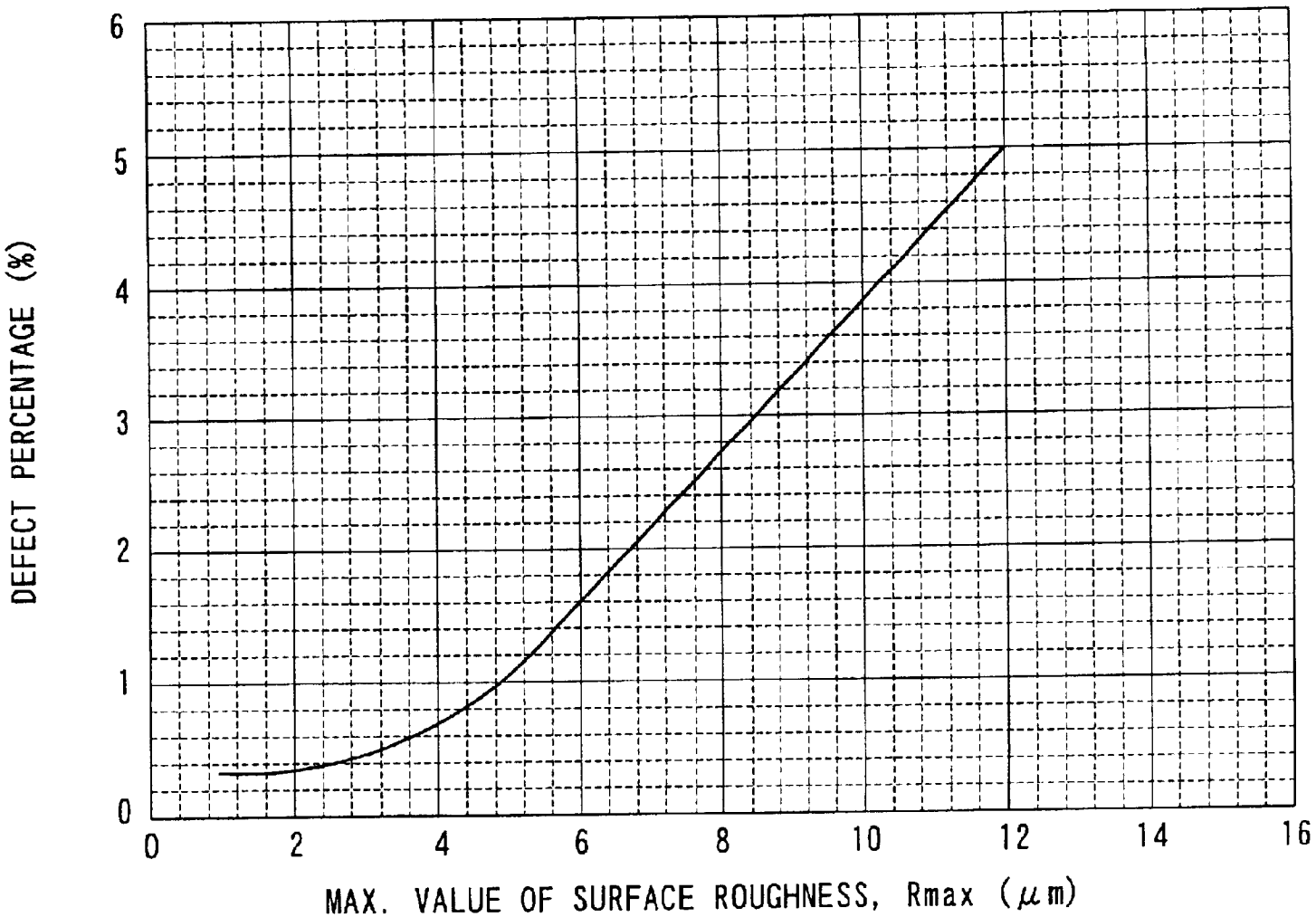
FIG. 6 is a graph showing the relationship between the maximum value, $R_{max}$, of the surface roughness of an electrode at a contacting surface and the defect percentage.

FIG. 6 is a graph showing the relationship between the maximum value, $R_{max}$, of the surface roughness of an electrode at the contacting portion and the defect percentage. In the example shown in FIG. 6, the power supplied to the high pressure discharge lamp was 200 W, the diameter $\phi$ of the electrode was 0.6 (mm), and the length of the contacting portion formed by contacting the electrode and the quartz glass bulb was 1.2 (mm). The surface roughness of the electrode was measured by using a contact-type surface roughness measuring instrument. The maximum value, $R_{max}$, of the surface roughness of the electrode is defined as the maximum of the absolute value of the difference between the distance from the axial center of the electrode to a particular point on the surface of the electrode and the mean value of the distance.

As shown in FIG. 6, the defect percentage decreases as the surface roughness of the contacting surface of the electrode decreases. As mentioned above, since a defect percentage of less than 1% at the termination of the lifetime of the high pressure discharge lamp is generally required, the surface roughness of the contacting surface of the electrode is preferably about 5 $\mu$m or less, and more preferably in the range between about 2 $\mu$m and 3 $\mu$m. The above-mentioned generation of cracks due to the surface roughness of an electrode may be prevented by forming the surface of the electrode having the above-mentioned roughness.

The maximum value, $R_{max}$, of the surface roughness of an electrode which may be obtained by subjecting a surface to machining is generally about 12 $\mu$m. In this embodiment of the present invention, the maximum value, $R_{max}$, of the surface roughness of an electrode at the contacting portion in the range between about 2 $\mu$m and 3 $\mu$m is realized by carrying out a polishing process after the machining process, such as electrolytic polishing, barrel polishing, or a combination thereof. Electrolytic polishing is a method in which a surface of an electrode is smoothed by immersing the electrode in an acidic solution and applying an electric field to the electrode to etch the convex portion present on the surface of the electrode. Barrel polishing is a method in which the surface is smoothed by mechanically pressing the convex portion of the surface.

However, although a technique for smoothing the surface of an electrode by polishing it using such a method as the above-mentioned electrolytic polishing method, barrel polishing method, or composite electrolytic polishing method is conventionally known, it was not known that the blackening of a quartz glass bulb due to the generation of sputtering of an electrode may be prevented if the $R_{max}$ value of the end portion of the electrode is less than a certain value. Also, it was not known that a blowout of a high pressure discharge lamp may be prevented if the $R_{max}$ value of portions of the electrode other than the end portion thereof is within a certain range.

Figure 7:
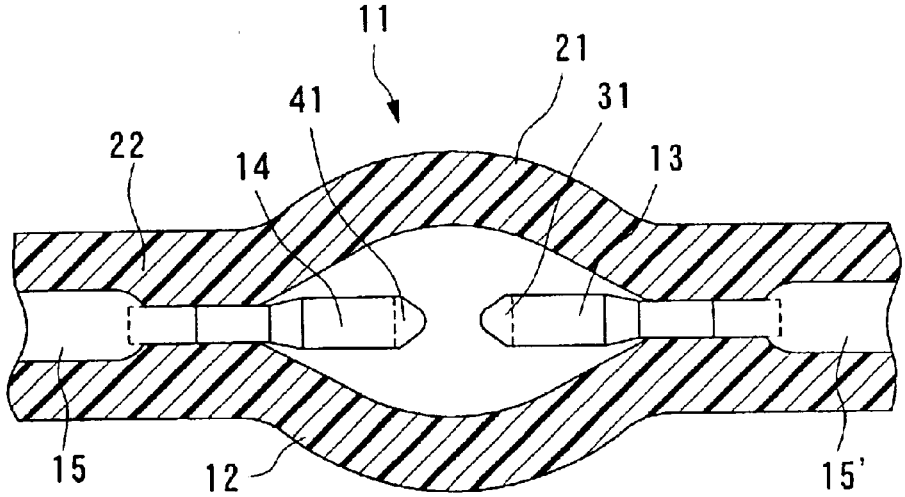
FIG. 7 is a diagram showing a schematic cross-sectional view of a high pressure discharge lamp according to an embodiment of the present invention.

FIG. 7 is a diagram showing a schematic cross-sectional view of a high pressure discharge lamp according to an embodiment of the present invention. In FIG. 7, a high pressure discharge lamp 11 includes a synthetic quartz glass bulb 12, an anode 13, a cathode 14, and molybdenum foils 15 and 15'. The synthetic quartz glass bulb 12 has an expanded portion 21. The shape of the expanded portion 21 is not particularly limited and may be spherical or oval-spherical. The shape of the anode 13 and that of the cathode 14 may be the same or can be different. The distance between the anode 13 and the cathode 14 is not particularly limited. The anode 13 and the cathode 14 are joined to the molybdenum foils 15 and 5' by, for example, a welding process. The quartz glass bulb 12 is airtightly sealed with the molybdenum foils 15 and 15' at a sealing portion 22. A gas for assisting a discharge, such as mercury vapor, is contained and sealed in the expanded portion 21.

In this specification, the term "an end of an electrode" indicates an end of an electrode along the length thereof which faces an opposite electrode side. The term "an end portion of the electrode" means the portion of the electrode which contributes to the discharge by the electrode and the portion may be expressed by the length between the end of the electrode and a certain distance away from the end of the electrode along the length thereof. The length may vary in accordance with the electric power supplied to the high pressure discharge lamp. More specifically, it is preferable, when the electric power supplied to the high pressure discharge lamp is expressed by P (in W), that the length be in the range between about P/150 and P/100 (in (mm)). That is, for instance, the length is 0.8–1.2 (mm) when P=120 W, 1.2–1.8 (mm) when P=180 W, and 1.33–2.0 (mm) when P=200 W. Note that if the anode and the cathode have the same shape, the above length is the same for the end portion of each of the electrodes. However, if the shapes of the electrodes are different, the lengths of the respective end portions are also different.

In the present invention, it is essential that the $R_{max}$ value of an end portion of an electrode be about 5 $\mu$m or less. If the $R_{max}$ is about 5 $\mu$m or less, it becomes possible to significantly reduce sputtering of an electrode in comparison with a conventional electrode and to prevent problems such as the blackening of a quartz glass bulb even after being lit for a considerably long time (for instance, more than 2,000 hours). According to the present invention, the smaller the $R_{max}$ of an end portion of an electrode, the greater the effect in reducing sputtering of the electrode. The $R_{max}$ of an end portion of an electrode is preferably about 3 $\mu$m or less, more preferably about 1 $\mu$m or less, and most preferably about 0.5 $\mu$m or less. If the $R_{max}$ of an end portion of an electrode is about 1 $\mu$m or less, problems associated with a quartz glass bulb such as the blackening of the bulb may be prevented even after being lit for more than 3,000 hours.

According to the present invention, the $R_{max}$ of portions of an electrode other than the end portion thereof is preferably in the range between about 5 and 12 $\mu$m, and more preferably in the range between about 7 and 9 $\mu$m. When a high pressure discharge lamp is produced, a quartz glass is heated to a certain temperature so that an electrode may be sealed at a sealing portion of the quartz glass. After that, the quartz glass is cooled down, and a substantial solidification of the quartz glass is started at about the annealing temperature thereof. At that time, if the $R_{max}$ of portions of an electrode other than the end portion thereof is in the range between about 5 and 12 $\mu$m, the electrode and the quartz glass is tightly sealed to prevent a blowout of the high pressure discharge lamp even after being lit for a considerably long time (for instance, more than 2,000 hours). Also, if the $R_{max}$ is in the range between about 7 and 9 $\mu$m, it becomes possible to prevent a blowout of the high pressure discharge lamp even after being lit, for instance, for more than 2,500 hours. In this specification, the term "portions of an electrode other than the end portion thereof" means the portions of an electrode located in an expanded portion for luminescence of the quartz glass bulb, i.e., the portions of the electrode separated from the quartz glass bulb, other than the end portion and the contacting portion of the electrode.

According to the present invention, mercury vapor is contained in the high pressure discharge lamp. The amount of the mercury vapor is preferably in the range between about 0.12 and 0.3 mg/(mm)$^3$, and more preferably in the range between about 0.18 and 0.24 mg/(mm)$^3$. If the amount of the mercury vapor is in the range between about 0.12 and 0.3 mg/(mm)$^3$, the luminous efficacy of the high pressure discharge lamp may be enhanced, and the generation of blackening or a blowout during its operation may be prevented.

According to the present invention, a halogen gas is contained in the high pressure discharge lamp. The amount of the halogen gas is preferably in the range between about $10^{-8}$ and $10^{-2}$ $\mu$l mol/(mm)$^3$, and more preferably in the range between about $10^{-6}$ and $10^{-4}$ $\mu$mol/(mm)$^3$. If the amount of the halogen gas is in the range between about $10^{-8}$ and $10^{-2}$ $\mu$mol/(mm)$^3$, the luminous efficacy of the high pressure discharge lamp may be enhanced and the generation of blackening or a blowout during its operation may be prevented. Examples of the halogen gas which may be used in the present invention include chlorine gas, bromine gas, and iodine gas, and one or more of these gases may be contained in the lamp. If more than two species of gases are contained, it is preferable that the total amount of the gases be in the range between about $10^{-8}$ and $10^{-2}$ $\mu$mol/(mm)$^3$.

According to the present invention, an inert gas is contained in the high pressure discharge lamp. The pressure of the inert gas in the lamp is preferably about 6 kPa or more, and more preferably in the range between about 20 and 50 kPa. If the pressure of the inert gas is about 20 kPa or more, the luminous efficacy of the high pressure discharge lamp may be enhanced and the generation of blackening or a blowout during its operation may be prevented. Examples of the inert gas which may be used in the present invention include helium gas, neon gas, argon gas, krypton gas, and xenon gas, and one or more of these gases may be contained in the lamp. If more than two species of inert gases are contained, it is preferable that the total pressure of the gases be about 50 kPa or less.

According to the present invention, the bulb wall loading in the high pressure discharge lamp is preferably about 0.8 W/(mm)$^2$ or more, and more preferably in the range between about 1.2 and 1.8 W/(mm)$^2$. If the bulb wall loading is about 0.8 W/(mm)$^2$ or more, the luminous efficacy of the high pressure discharge lamp may be enhanced and the generation of blackening or a blowout during its operation may be prevented.

According to the present invention, the materials used for an anode and a cathode are preferably tungsten, molybdenum, and tantalum. The use of tungsten is more preferable and that of tungsten containing potassium oxide is especially preferable. The amount of potassium oxide in tungsten is preferably about 30 ppm or less. If tungsten containing potassium oxide is used, the luminous efficacy of the high pressure discharge lamp may be enhanced and the generation of blackening or a blowout during its operation may be prevented.

According to the present invention, the method for making or polishing an end portion of an electrode is not particularly limited as long as it can achieve the $R_{max}$ of the end portion 5 $\mu$m or less. Examples of such methods include an electrolytic polishing method and a composite electrolytic polishing method. It is preferable to employ the composite electrolytic polishing method since it can achieve the polishing of an electrode in an accurate and efficient manner.

The characteristics of an embodiment of the high pressure discharge lamp according to the present invention are described as follows:

| | |
|---|---|
| Electric power of the discharge lamp: | 120–200 W |
| Voltage of the discharge lamp: | 50–100 V |
| Distance between the electrodes: | 1.0–2.0 mm |
| Luminous efficacy: | 40–70 lm/W |
| Load applied to the bulb wall: | 0.8–1.5 W/mm$^2$ |
| Radiation wavelength: | 360–700 nm |

The high pressure discharge lamp according to the present invention may be used in the same manner as a conventional high pressure discharge lamp. That is, when the high pressure discharge lamp of the present invention is connected to a power source, a trigger voltage is applied to the cathode and the anode in order to start the discharge. In this manner, a desired brightness of the lamp may be obtained. Also, according to the present invention, it becomes possible to provide a high pressure discharge lamp which, even after being lit for a considerably long time, does not have problems such as a blowout of the bulb made of quartz glass or the blackening of the quartz glass bulb.

Next, the present invention will be described in more detail with reference to particular embodiments. However, the present invention is not by any means to be restricted to the following embodiments.

Embodiments 1–3 and Comparative Embodiment 1

Using a high pressure discharge lamp having a structure as shown in FIG. 7, the amount of time needed for the generation of blackening of the high pressure discharge lamp was measured (i.e., the time required for the luminance of the lamp to be reduced to 50% by blackening). The anode 13 and the cathode 14 were made of tungsten containing 20 ppm of potassium oxide. The amount of mercury vapor contained was 0.2 mg/(mm)$^3$, that of bromine gas was $1\times10^{-4}$ $\mu$mol/(mm)$^3$, and the pressure of argon gas contained was 30 kPa. The supplied power to the high pressure discharge lamp was 180 W. A part of the electrode, i.e., from the end thereof to 1.5 (mm) away from the end along the length, was polished by using the composite electrolytic polishing method so that the $R_{max}$ thereof became 0.5 $\mu$m for the high pressure discharge lamp in Embodiment 1, 2 $\mu$m for the lamp in Embodiment 2, 4 $\mu$m for the lamp in Embodiment 3, and 7 $\mu$m for the lamp in Comparative Embodiment 1. Also, the $R_{max}$ value for portions other than the end portion of each electrode was adjusted to be 8 $\mu$m. The time required for each of the above high pressure discharge lamps to be blackened after being lit was measured.

As a result, the time required for each of the high pressure discharge lamps to be blackened was 3,000 hours in Embodiment 1, 2, 650 hours in Embodiment 2, 2, 200 hours in Embodiment 3, and 1,000 hours in Comparative Embodiment 1 and it was confirmed that if the $R_{max}$ of the end portion of the electrode is 5 $\mu$m or less, the time required for the lamp to be blackened may be extended to 2,000 hours or more. The high pressure discharge lamp in Embodiment 1, whose $R_{max}$ value was 0.5 $\mu$m was the most excellent at exhibiting such an effect.

Embodiments 4–6 and Comparative Embodiments 2 and 3

The time required for the generation of a crack after lighting a high pressure discharge lamp was measured by using the same conditions as in Embodiment 1, except that the $R_{max}$ value for portions other than the end portion of the electrode was 3 $\mu$m for the high pressure discharge lamp in Comparative Embodiment 2, 6 $\mu$m for the lamp in Embodiment 4, 8 $\mu$m for the lamp in Embodiment 5, 10 $\mu$m for the lamp in Embodiment 6, and 14 $\mu$m for the lamp in Comparative Embodiment 3.

As a result, all of the high pressure discharge lamps in Embodiments 4–6 were capable of extending the time needed for the generation of a crack to more than 2,000 hours. Among them, the high pressure discharge lamp in Embodiment 5, whose $R_{max}$ value was 8 $\mu$m had the most excellent effect. On the other hand, the time required for the generation of a crack of the lamps in Comparative Embodiments 2 and 3 were 1,800 and 1,500 hours, respectively, and these lamps could not extend the time required for the generation of a crack.

Having thus described exemplary embodiments of the invention, it will be apparent that various alterations, modifications, and improvements will readily occur to those skilled in the art. Such alterations, modifications, and improvements, though not expressly described above, are nonetheless intended and implied to be within the spirit and scope of the invention. Accordingly, the foregoing discussion is intended to be illustrative only; the invention is limited and defined only by the following claims and equivalents thereto.

What is claimed is:

1. A method for sealing a bulb of a high pressure discharge lamp including a first electrode and a second electrode, said first and second electrodes being disposed in said bulb having a first insertion opening and a second insertion opening so as to be opposite the other, comprising:

disposing said first electrode at said first insertion opening so that said first electrode is placed at a predetermined position in an axial direction;

heating a predetermined portion of said first insertion opening while maintaining a pressure difference between an inside and outside of said bulb;

shrinking said predetermined portion of said first insertion opening in a natural state so that a part of said first electrode is sealed with said predetermined portion;

disposing said second electrode at said second insertion opening so that said second electrode is placed at a predetermined position in the axial direction;

heating a predetermined portion of said second insertion opening while maintaining a pressure distance between the inside and outside of said bulb; and shrinking said predetermined portion of and second insertion opening in a natural state so that a part of said second electrode is sealed with said predetermined portion, wherein the length of a contacting portion formed by sealing said part of said first electrode with said bulb, and by said part of said second electrode with said bulb, is in the range between:

a maximum length, $L_{max}$, of the contacting portion is defined as:

$L_{max}((mm))\leqq 200(P\times D)$; and a minimum length, $L_{min}$ of the contacting portion is defined as:

$L_{min}((mm))\geqq 0.8/(D^2\times\pi)$ or $L_{min}((mm))\geqq 0.7$ whichever is longer, wherein D is the diameter ((mm)) of at least one of said first electrode and said second electrode and P is the power (W) supplied to at least one of said first electrode and said second electrode, and wherein a maximum value of a surface roughness of a portion other than the end portion of each of said first and second electrodes is in a range between about 5 $\mu$m and 12 $\mu$m.

2. The method of claim 1, wherein mercury vapor is contained in the high pressure discharge lamp in an amount between about 0.12 and 0.3 mg/(mm)$^3$.

3. The method of claim 1, wherein a halogen gas is contained in the high pressure discharge lamp in an amount between about $10^{-8}$ and $10^{-2}$ $\mu$mol/(mm)$^3$.

4. The method of claim 1, wherein an inert gas is contained in the high pressure discharge lamp with a pressure of about 6 kPa or more.

5. The method of claim 1, wherein said first and second electrodes comprise tungsten containing potassium oxide.

6. The method of claim 1, wherein a bulb wail touting in the high pressure discharge lamp is about 0.8 W/Presented (mm)$^3$ or more.

7. The method according to claim 1, wherein said pressure difference is produced by evacuating said bulb without adding an inert gas into said bulb.

8. The method according to claim 1, wherein said bulb is inn vacuum state with a partial pressure of oxygen of $2.5\times10^{-3}$ Pa or less.

9. The method according to claim 1, wherein said pressure difference is 101 kPa in a vacuum state.

10. The method according to claim 1, wherein said pressure difference as 41 kPa–95 kPa with an inert gas introduced into said bulb.

11. The method according to claim 1, further comprising:

inserting Mo foil such that said Mo foil and said predetermined portion are airtightly sealed with said bulb.

* * * * *